US010099074B2

(12) United States Patent
Butterfield, IV

(10) Patent No.: US 10,099,074 B2
(45) Date of Patent: Oct. 16, 2018

(54) FALL PROTECTION DEVICE AND SYSTEMS AND METHODS FOR USE THEREOF

(71) Applicant: Chevron U.S.A. Inc., San Ramon, CA (US)

(72) Inventor: Albert E. Butterfield, IV, Novato, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 32 days.

(21) Appl. No.: 15/452,235

(22) Filed: Mar. 7, 2017

(65) Prior Publication Data

US 2018/0256927 A1 Sep. 13, 2018

(51) Int. Cl.
*E04G 3/28* (2006.01)
*A62B 35/00* (2006.01)

(52) U.S. Cl.
CPC ..... *A62B 35/0068* (2013.01); *A62B 35/0081* (2013.01)

(58) Field of Classification Search
CPC ..... A62B 35/0068; A62B 35/0081
See application file for complete search history.

(56) References Cited

U.S. PATENT DOCUMENTS 2,815,556 A * 12/1957 Neil ..... A62B 35/0068 24/327
3,217,833 A * 11/1965 Smith ..... E04G 21/3261 182/3
4,539,732 A 9/1985 Wolner
5,687,535 A 11/1997 Rohlf
6,076,633 A 6/2000 Whitmer
6,167,986 B1 1/2001 Calvillo
6,467,573 B1 10/2002 Parker
2011/0155505 A1* 6/2011 Liang ..... A62B 35/0081 182/3
2013/0327591 A1* 12/2013 Galpin ..... A62B 35/0081 182/3
2014/0008511 A1 1/2014 Bove
2014/0262608 A1 9/2014 Patel et al.
2016/0356050 A1* 12/2016 Tsaousis ..... E04G 21/3242

FOREIGN PATENT DOCUMENTS

JP 3493157 B2 * 2/2004 ..... A62B 1/14

* cited by examiner

*Primary Examiner* — Jerry E Redman
(74) *Attorney, Agent, or Firm* — Karen R. DiDomenicis

(57) ABSTRACT

Disclosed is a fall protection device, and methods and systems for using the device, that can be attached to a structural beam at elevated heights. The device includes an upper component and a lower component adapted to fit together around the structural beam, and a pair of quick release pins for passing through a pair of transverse openings in the upper component and the lower component. The upper component has a generally L-shaped profile and includes a horizontal leg having a slot in the lower surface along the length thereof for receiving an upper portion of the lower component having a thickness less than the slot thickness. The device includes at least one transverse opening through the upper and/or lower component for tying off one or more safety lines. The upper and/or lower component includes vertically and horizontally oriented rollers for moving the device along the structural beam when attached.

19 Claims, 10 Drawing Sheets

FALL PROTECTION DEVICE AND SYSTEMS AND METHODS FOR USE THEREOF

FIELD

The present invention relates generally to safety devices for protecting workers performing operations at elevated heights. In particular, the invention relates to fall protection devices adapted to be securely and releasably attached to structural beams at elevated heights, to which a safety line or other device, connected to a worker, may be attached.

BACKGROUND

Workers rely on fall protection devices when working at elevated heights when performing operations including e.g., construction, cleaning and/or repairs. Fall protection devices are known that can be secured to L-shaped beams attached to structures at elevated heights. For instance, structures having walls of from six feet to hundreds of feet high frequently have a generally L-shaped structural beam also known as an angle fixed to the top of the wall. Examples of such structures include storage tanks, reactors, vessels, buildings, walls and bridges. For example, large storage tanks frequently have a wind girder or walkway near the top of the tank. Workers walking onto the elevated walkway must be tied off to prevent falls. There exists a need for an improved fall protection device that is simple to use, inherently safe and movable during use.

SUMMARY

In one aspect, a fall protection device is provided for protecting workers at elevated height. The fall protection device is adapted to be securely attached to a structural beam having a horizontal planar beam leg and a vertical planar beam leg that intersect to form an angle having an outside corner and an inside corner. The horizontal planar beam leg has an upper surface forming an upper surface of the structural beam. The fall protection device includes an upper component and a lower component adapted to fit together around the structural beam, and a pair of quick release pins for passing through a pair of transverse openings in the upper component and the lower component to secure the upper component to the lower component. The upper component of the fall protection device has a generally L-shaped profile and includes a vertical leg and a horizontal leg having a length and a lower surface for contacting the upper surface of the structural beam. The horizontal leg has a slot in the lower surface along the length of the horizontal leg. The horizontal leg has two openings, i.e., a proximal opening and a distal opening with respect to the intersection of the vertical leg and the horizontal leg passing through the slot wherein the two openings are transverse to the length of the horizontal leg. The vertical leg has a height and a forward surface for contacting the structural beam when the upper component is positioned adjacent the outside corner of the structural beam. An upper pair of rollers is mounted on a pair of horizontal axes oriented parallel to the length of the horizontal leg. The horizontal axes are securely fixed to opposite lateral sides of the horizontal leg, such that the upper pair of rollers extend below the lower surface of the horizontal leg. A lower pair of rollers is mounted on a pair of vertical axes wherein the vertical axes are securely fixed to opposite lateral sides of the vertical leg, such that the lower pair of rollers extend forward of the vertical surface of the vertical leg. The lower component of the fall protection device includes an upper portion having a thickness less than the slot thickness such that the upper portion can fit into the slot and two openings, i.e., a proximal opening and a distal opening that align with the two openings of the horizontal leg when the upper portion is inserted into the slot. The lower component also includes a corner portion having a horizontal surface and a vertical surface for contacting the inside corner of the structural beam. A partial slot is located between the upper portion and the corner portion for accommodating the horizontal planar beam leg of the structural beam. A pair of lower component rollers is mounted on a pair of vertical axes wherein the vertical axes are securely fixed to opposite lateral sides of the corner portion, such that the pair of lower component rollers extend rearward from the vertical surface. The fall protection device includes at least one transverse opening through the upper component and/or the lower component for tying off one or more safety lines.

In another aspect, a method is provided for protecting workers during an operation at elevated height. The method includes providing the generally L-shaped structural beam as described above at an elevated height; positioning the lower component of the fall protection device such that the horizontal and vertical surfaces of the corner portion of the lower component contact the inside corner of the structural beam at a desired location along the structural beam; positioning the upper component of the fall protection device over the upper portion of the lower component such that the upper portion of the lower component fits into the slot of the upper component and the distal openings of the upper component and the lower component align; placing one of the pair of quick release pins through the aligned distal openings of the upper component and the lower component; positioning the upper component of the fall protection device over the upper portion of the lower component such that the upper portion of the lower component fits into the slot of the upper component and the proximal openings of the upper component and the lower component align; placing the other of the pair of quick release pins through the aligned proximal openings of the upper component and the lower component, thereby securing the fall protection device to the structural beam; and tying off one or more safety lines to the transverse opening through the upper component and/or the lower component.

In another aspect, a system is provided for protecting workers during an operation at elevated height. The system includes the generally L-shaped structural beam capable of being securely attached to an elevated structure selected from the group consisting of a storage tank, a reactor, a vessel, a building, and a bridge; and the fall protection device as described above, capable of being secured to the structural beam.

BRIEF DESCRIPTION OF THE DRAWINGS

These and other objects, features and advantages of the present invention will become better understood with reference to the following description, appended claims and accompanying drawings. The drawings are not considered limiting of the scope of the appended claims. The elements shown in the drawings are not necessarily to scale. Reference numerals designate like or corresponding, but not necessarily identical, elements.

DETAILED DESCRIPTION

Figure 9:
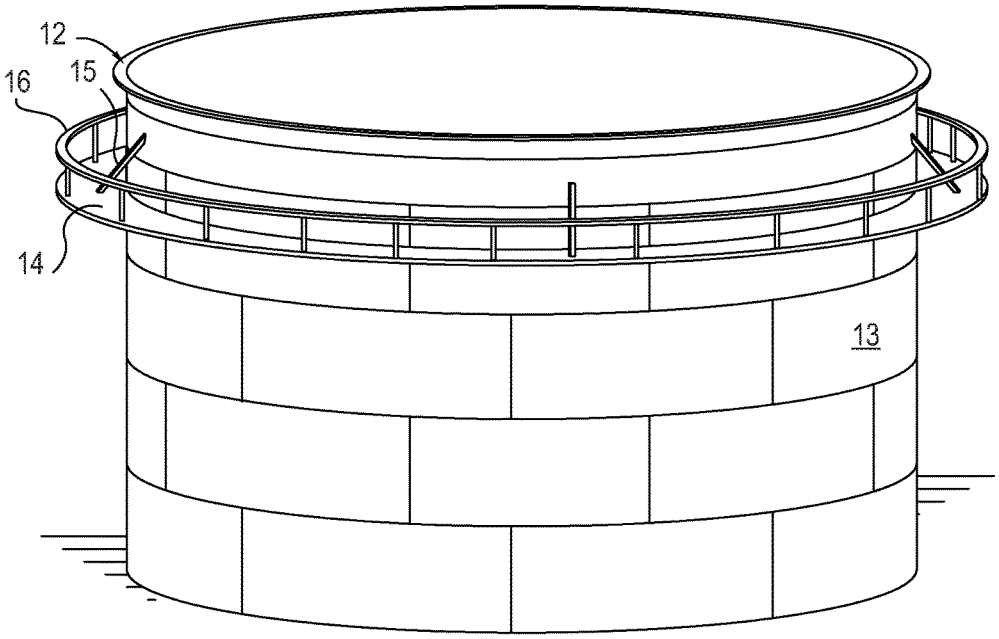
FIG. 9 is a view of a tank wall having a generally L-shaped structural beam at the top thereof to which the fall protection device of the present disclosure can be attached.

The present disclosure relates to a fall protection device that permits personnel to secure themselves for safety purposes when working to perform various operations at elevated heights. The device can be secured to L-shaped beams securely attached to structures at elevated heights. For instance, as seen in FIG. 9, structures having walls 13 of from six feet to hundreds of feet high frequently have a generally L-shaped structural beam 12 also known as an angle fixed to the top of the wall 13 or integral with the wall 13. As seen in FIG. 9, such structures can have a wind girder or walkway 14 secured in part by braces 15. The walkway 14 may have a handrail 16.

The fall protection device can be suitable for safely securing personnel during operations such as, but not limited to, construction, cleaning or repair operations inside, atop, or outside the structures. Such structures can include, but are not limited to, storage tanks, reactors, vessels, buildings and bridges. In one embodiment, the structural beam can be located at an elevated height and spanning an open space between structures. In one embodiment, the structural beam is temporarily securely attached to the elevated structure. In another embodiment, the structural beam is permanently securely attached to the elevated structure.

Figure 1:
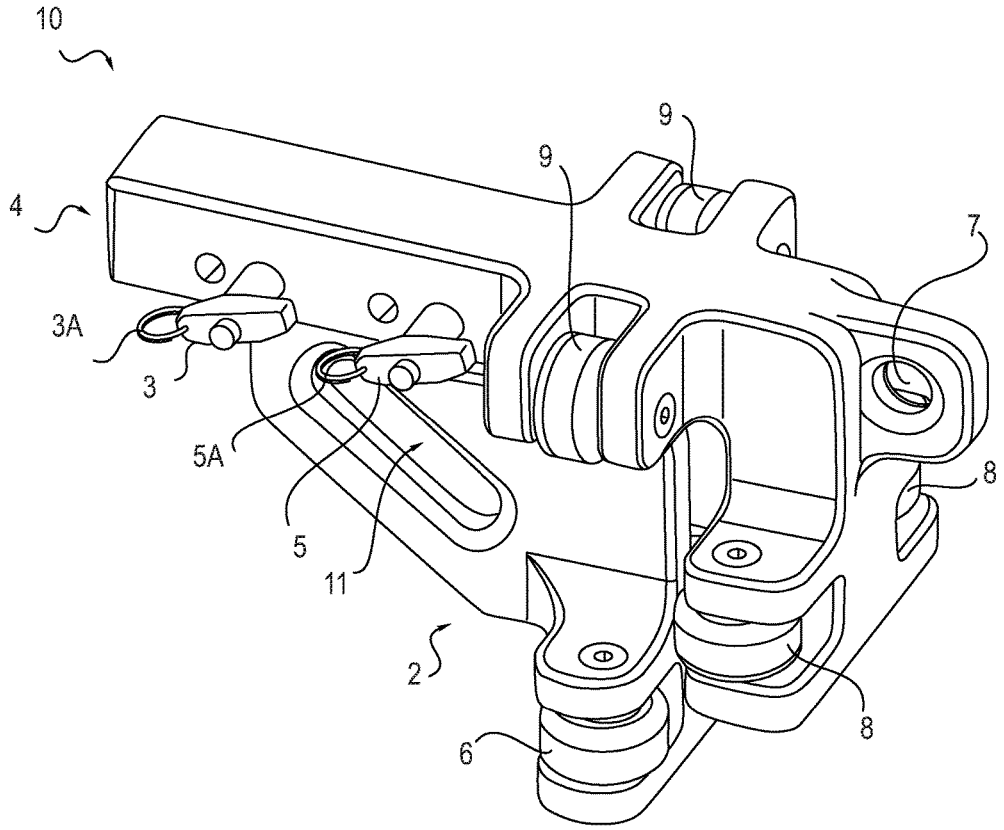
FIG. 1 is a perspective view of one embodiment of the fall protection device.
Figure 10:
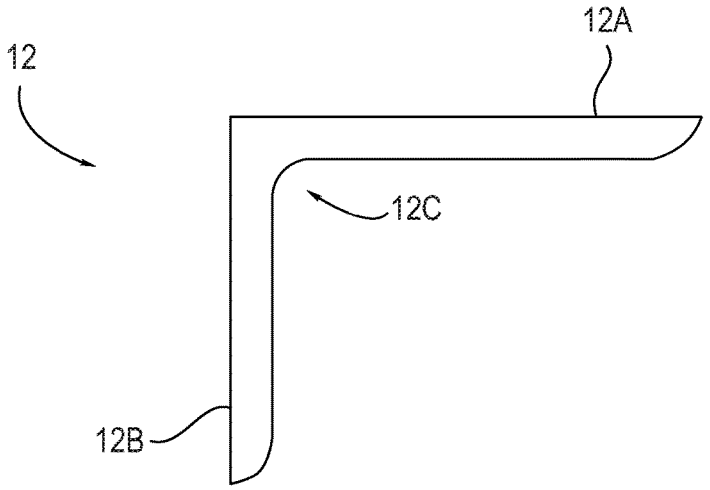
FIG. 10 is a cross-sectional view of a generally L-shaped structural beam to which the fall protection device of the present disclosure can be attached.

As shown in FIG. 1, in one embodiment, the fall protection device 10 includes an upper component 4 and a lower component 2, designed to cooperate to fit together securely around a structural beam 12 as shown in cross-section in FIG. 10. The cross-sectional shaped structural beam 12 can be generally L-shaped but can also include other shapes as long as the top of the structural beam 12 is generally L-shaped, having a horizontal planar beam leg 12A and a vertical planar beam leg 12B that intersect to form an angle having an outside corner 12C and an inside corner 12D. The horizontal planar beam leg 12A has an upper surface forming an upper surface of the structural beam. Angles having equal and unequal legs of various lengths and thicknesses are well known.

Figure 2:
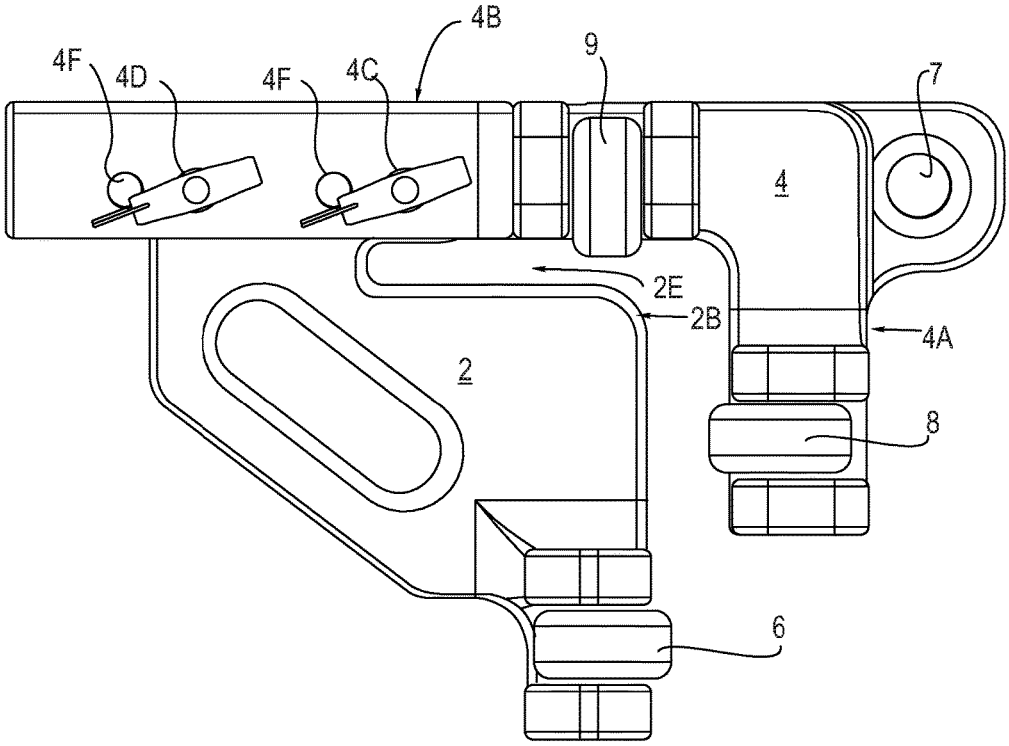
FIG. 2 is a side view of one embodiment of the fall protection device.
Figure 3:
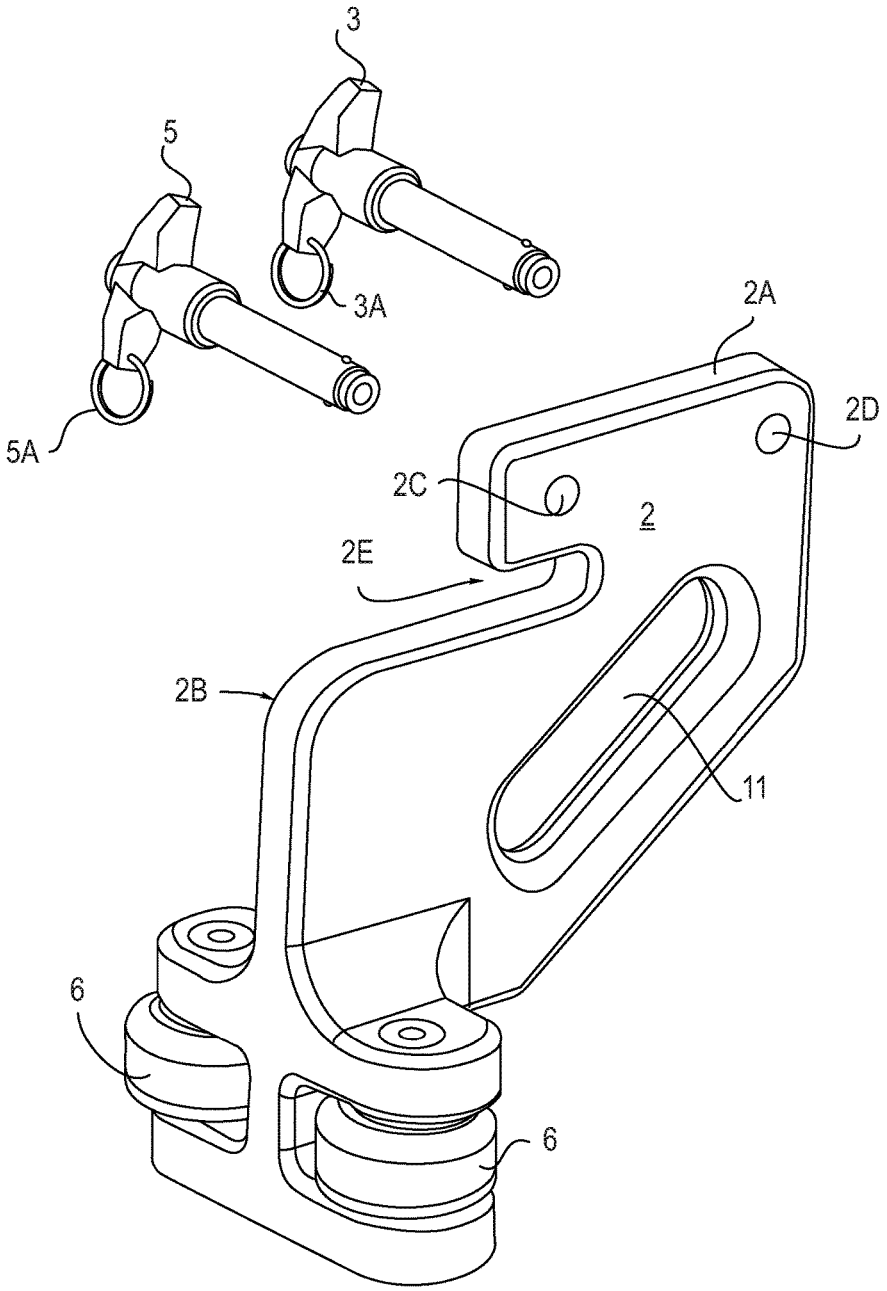
FIG. 3 is a perspective view of one embodiment of the lower component and the pair of quick release pins of the fall protection device.

Referring to FIG. 1 (perspective view) and FIG. 2 (side view), the fall protection device 10 further includes a pair of quick release pins 3 and 5 for passing through a pair of transverse holes through the upper component 4 and the lower component 2 to secure the upper component 4 to the lower component 2. The term hole and openings are used interchangeably herein.

The upper component 4 has a profile that is shaped to generally fit around the outside corner 12C of the structural beam 12. The upper component 4 has an inner surface that is generally L-shaped and corresponds to the outer surface of structural beam 12. The side view of FIG. 2 best shows the gap between the upper component 4 and the lower component 2 that generally corresponds to the cross-sectional shape of the structural beam 12 in a one embodiment of the fall protection device.

Figure 4:
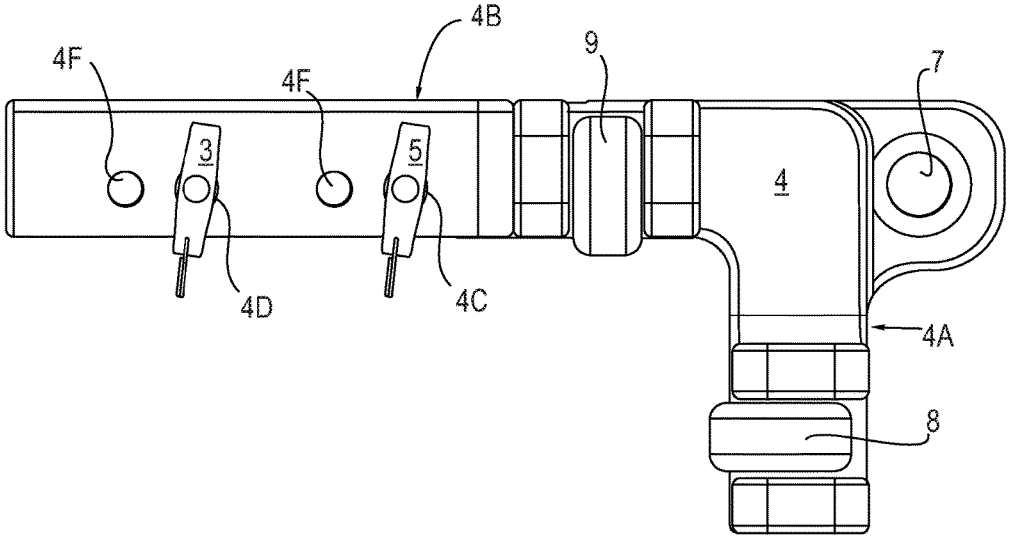
FIG. 4 is a side view of one embodiment of the upper component of the fall protection device.
Figure 5:
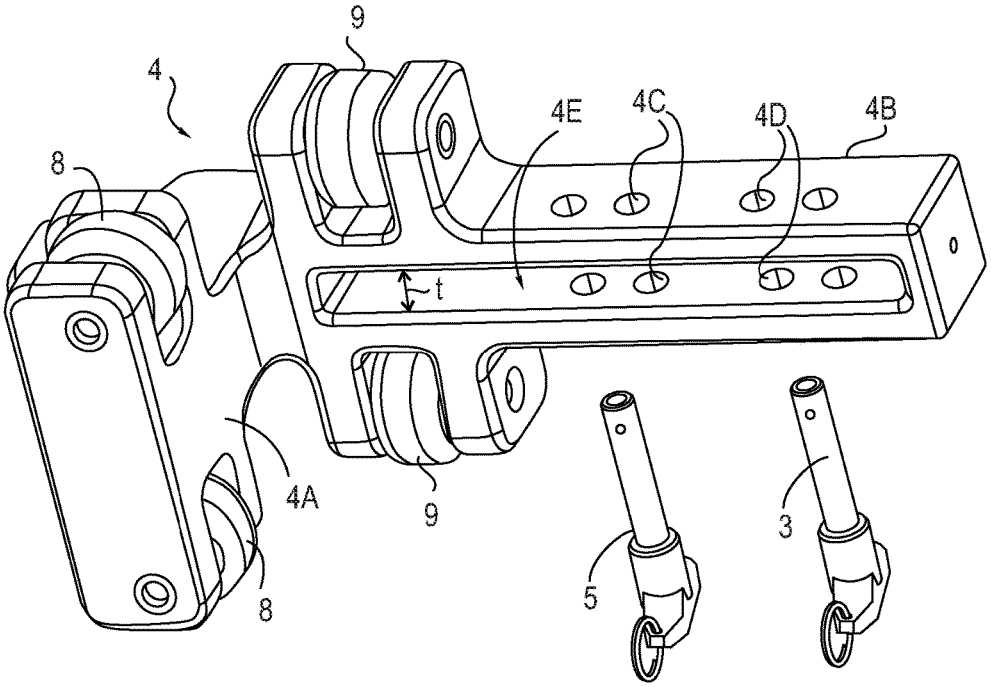
FIG. 5 is a perspective view of the bottom of one embodiment of the upper component of the fall protection device.
Figure 6:
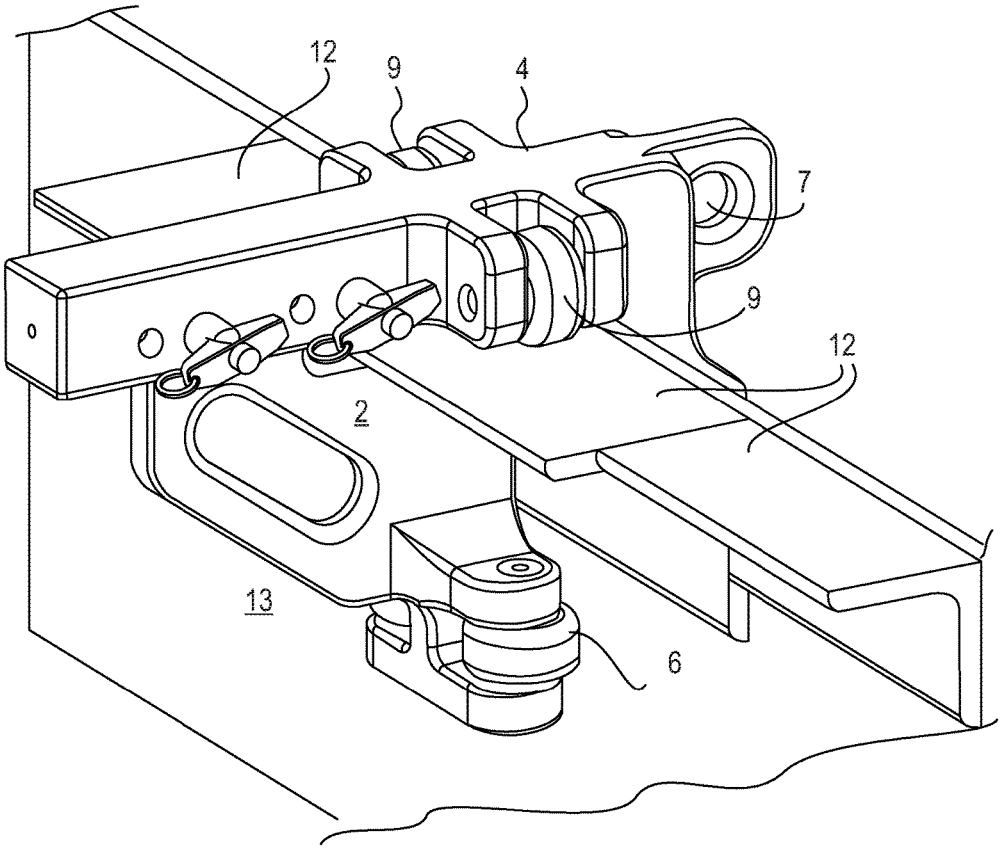
FIGS. 6-8 are perspective views of one embodiment of the fall protection device engaged with an L-shaped beam as viewed from various angles.
Figure 7:
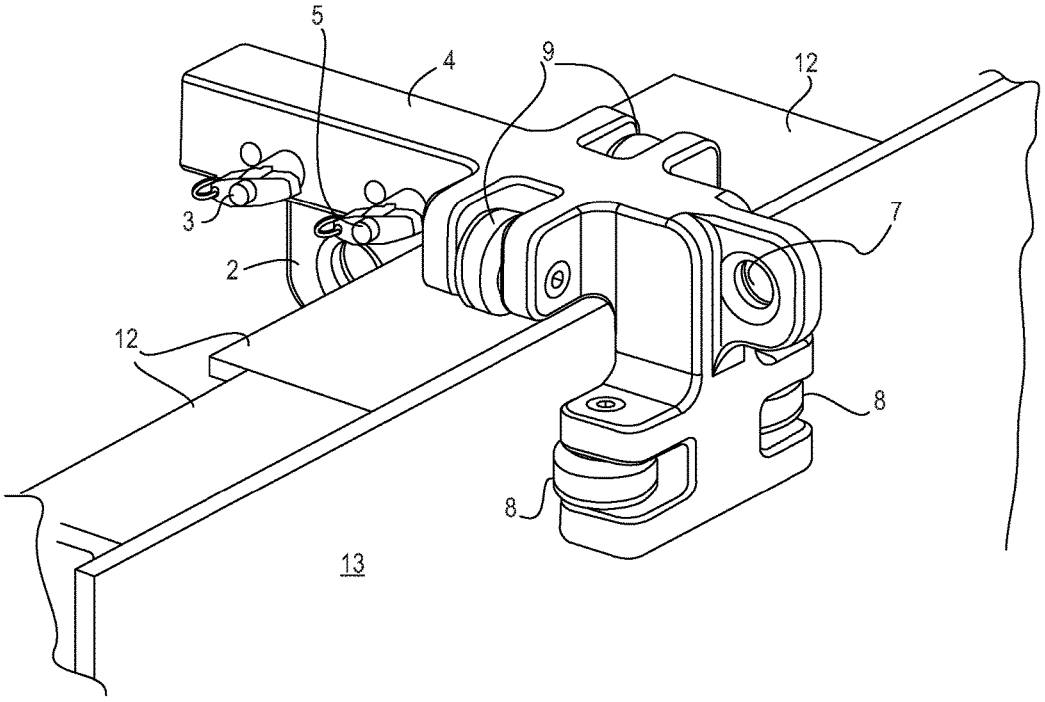
Figure 8:
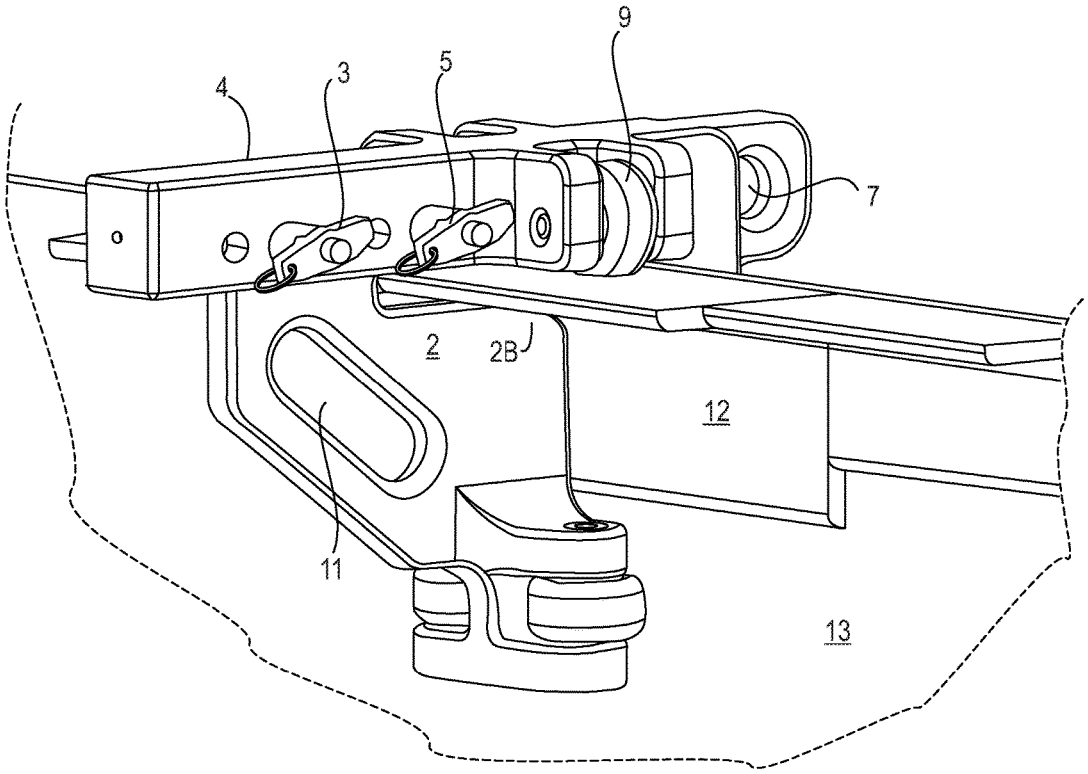

The upper component 4 includes a vertical leg 4A and a horizontal leg 4B having a length and a lower surface for contacting the upper surface of the structural beam 12. Best seen in FIG. 5, the horizontal leg 4B has a slot 4E in the lower surface along a substantial portion of the length of the horizontal leg 4B. The slot 4E has a thickness t. The horizontal leg 4B has at least two transverse holes there through, i.e., a proximal hole 4C and a distal hole 4D with respect to the intersection of the vertical leg 4A and the horizontal leg 4B (also seen in FIG. 4). The proximal hole 4C and distal hole 4D pass through the slot 4E and run transverse to the length of the horizontal leg 4B. The vertical leg 4A has a height and a forward surface for contacting the structural beam 12 when the upper component 4 is positioned adjacent the outside corner 12C of the structural beam 12.

An upper pair of rollers 9 is mounted on a pair of horizontal axes (not shown) oriented parallel to the length of the horizontal leg 4B. The horizontal axes are securely fixed to opposite lateral sides of the horizontal leg 4B, such that the upper pair of rollers 9 extend below the lower surface of the horizontal leg 4B, best seen in FIG. 4. The rollers 9 extend from 0.25 to 0.50 inch below the lower surface of the horizontal leg 4B, thus allowing the upper component 4 to make rolling contact with the upper surface of the structural beam 12. A lower pair of rollers 8 is mounted on a pair of vertical axes (not shown) that are securely fixed to opposite lateral sides of the vertical leg 4A, such that the lower pair of rollers 8 extend forward of the vertical surface of the vertical leg 4A. The rollers 8 extend from 0.25 to 0.50 inch forward of the vertical surface, thus allowing the upper component 4 to make rolling contact with the rear vertical surface of the structural beam 12.

The lower component 2 of the fall protection device 10 includes an upper portion 2A having a thickness less than the thickness t of the slot 4E in the horizontal leg 4B of the upper component 4, such that the upper portion 2A can fit into the slot 4E of the upper component 4. The upper portion 2A has two holes there through, i.e., a proximal hole 2C and a distal hole 2D that align with the two holes 4C and 4D of the horizontal leg 4B when the upper portion 2A is inserted into the slot 4E. In one embodiment, additional holes 4F can be provided through the horizontal leg 4B transverse to the length of the horizontal leg 4B, and additional holes (not shown) can be provided in the upper portion 2A of the lower component 2 to align with the additional holes of the horizontal leg 4B when the upper portion 2A is inserted into the slot 4E of the horizontal leg 4B. The additional holes provide the ability to adjust the fall protection device 10 to accommodate varying widths of the horizontal planar beam leg 12A of the structural beam 12.

The lower component 2 also includes a corner portion 2B having a horizontal surface and a vertical surface for contacting and generally fitting within the inside corner 12D of the structural beam 12.

A partial slot 2E is located between the upper portion 2A and the corner portion 2B for accommodating the horizontal planar beam leg 12A of the structural beam 12. A pair of lower component rollers 6 is mounted on a pair of vertical axes (not shown) that are securely fixed to opposite lateral sides of the corner portion 2B, at a lower end of the corner portion 2B as shown, such that the pair of lower component rollers 6 extend rearward from the vertical surface, i.e., the rear surface of the lower component 2. The rollers 6 extend from 0.25 to 0.50 inch rearward of the vertical surface, thus allowing the lower component 2 to make rolling contact with the front vertical surface of the structural beam 12.

Since the structural beam 12 has a thickness, when the lower component 2 and the upper component 4 are securely attached, as shown in FIGS. 1 and 2, a gap or space is present between lower component 2 and upper component 4. The gap has a clearance of from 0.25 to 0.50 inch in any direction between the structural beam 12 and the closest point of the lower component 2 and upper component 4.

The fall protection device 10 includes at least one transverse hole in the upper component 4 and/or the lower component 2 where a safety line (not shown) can be attached, i.e., tied off. In one embodiment, a hole 7 is provided in the upper component 4 as a tie off point. In one embodiment, a hole 11 is provided in the lower component 2 as a tie off point. Holes 7 and 11 can take any shape that will permit a safety line to be attached. As shown, the hole 11 can take the form of an oblong opening large enough to serve as a handle for the fall protection device 10. The at least one transverse hole can be located at any convenient location on the upper component 4 and/or the lower component 2. Multiple tie-off holes can be located at any convenient location on the upper component 4 or the lower component 2.

In one embodiment, any or all of the pairs of rollers, i.e., 9, 8 and/or 6, can include a mechanism for locking the rollers to prevent rolling during use as desired. Known locking mechanisms used to lock or brake rollers can be used, such as, but not limited to, a spring-loaded cam lock, a spring-loaded locking pin for pressing against and damping the rollers 9, 8 and/or 6, a spring-loaded locking pin for fitting into longitudinal holes in the rollers 9, 8 and/or 6, and the like (locking mechanism not shown).

In one embodiment, the upper component 4 and the lower component 2 are formed of aircraft grade aluminum. As nonlimiting examples of aircraft grade aluminum, 6061-T6 and 7075-T6 alloys can be used.

In one embodiment, the pairs of rollers, i.e., 9, 8 and/or 6, are formed of a high strength, durable engineering thermoplastic polymer. A nonlimiting example of a suitable engineering thermoplastic polymer is DuPont™ Delrin® acetal homopolymer.

In one embodiment, the length of the fall protection device 10, e.g., the length of the horizontal leg 4B is from 10 to 20 in. In one embodiment, the overall height of the fall protection device 10, e.g., lower component 2 and upper component 4, is from 6 to 12 in. In one embodiment, the width of the fall protection device 10 is from 4 to 8 in.

In one embodiment, each of the quick release pins 3 and 5 can be a pin, a bolt or other shaft capable of passing through the distal holes 4D and 2D and the proximal holes 4C and 2C and remaining in place. In one embodiment, as shown, the quick release pins 3 and 5 for passing through the pair of transverse holes in the upper component 4 and the lower component 2 each include an attachment means 3A and 5A, respectively, for attaching the quick release pins to tethers (not shown) for attaching to the workers' apparel or gear.

A method will be described for protecting workers during an operation performed at elevated height. The structural beam 12 is provided at an elevated height.

In one embodiment, the lower component 2 of the fall protection device 10 is positioned such that the horizontal and vertical surfaces of the corner portion 2B of the lower component 2 contact the inside corner 12D of the structural beam 12 at a desired location along the structural beam. The upper component 4 of the fall protection device 10 is positioned over the upper portion 2A of the lower component 2 such that the upper portion 2A of the lower component 2 fits into the slot 4E of the upper component 4. In one embodiment, the distal holes 4D and 2D of the upper component 4 and lower component 4, respectively, align. One of the pair of quick release pins 3 is placed through the aligned distal holes 4D and 2D of the upper component 4 and the lower component 2, respectively. The upper component 4 of the fall protection device is then positioned over the upper portion 2A of the lower component 2 such that the upper portion 2A of the lower component 2 fits into the slot 4E of the upper component 4 and the proximal holes 4C and 2C of the upper and lower components 4 and 2, respectively, align. The other of the pair of quick release pins 5 is placed through the aligned proximal holes 4C and 2C, thereby securing the fall protection device 10 to the structural beam 12.

In one embodiment, prior to positioning the fall protection device 10 at the desired location, the upper portion 2A of the lower component 2 is inserted into the slot 4E of the upper component 4 such that the distal holes 4D and 2D align and the quick release pin 3 is placed through the distal holes 4D and 2D, thereby attaching the upper component 4 and the lower component 2 in a hinged manner. The fall protection device 10 can then be opened and closed around the hinge formed by the quick release pin 3. The fall protection device 10 can then be positioned in an open position such that the corner portion 2B contacts the inside corner 12D at the desired location along the structural beam 12. The upper component 4 can then be lowered into a closed position thereby aligning the proximal holes 4C and 2C. The quick release pin 5 is then placed through the proximal holes 4C and 2C, thereby securing the fall protection device 10 to the structural beam 12.

In one embodiment, one or more safety lines (not shown) are tied off to the transverse hole(s) 7 and/or 11.

Once secured to the structural beam 12, the location of the fall protection device 10 along the structural beam can be changed by rolling the fall protection device 10 to additional desired locations using the upper pair of rollers 9, the lower pair of rollers 8 and the pair of lower component rollers 6. The safety lines remain tied off during the entire operation being performed by the worker.

It should be understood that "horizontal," "vertical," "front" and "rear" are relatively terms and are not intended to be limiting to a fixed point of reference.

It should be noted that only the components relevant to the disclosure are shown in the figures, and that many other components normally part of a fall protection system are not shown for simplicity.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. A fall protection device for protecting workers at elevated height and adapted to be securely attached to a structural beam comprising a horizontal planar beam leg and a vertical planar beam leg wherein the horizontal planar beam leg and the vertical planar beam leg intersect forming an angle having an outside corner and an inside corner and wherein the horizontal planar beam leg comprises an upper surface of the structural beam, the device comprising:

a. an upper component comprising:

i. a horizontal leg having a length and a lower surface for contacting the upper surface of the structural beam wherein the horizontal leg comprises a slot having a slot thickness in the lower surface along the length of the horizontal leg and two openings comprising a proximal opening and a distal opening through the horizontal leg passing through the slot wherein the two openings are transverse to the length of the horizontal leg;

ii. a vertical leg having a height and a forward surface for contacting the structural beam when the upper component is positioned adjacent the outside corner of the structural beam;

iii. an upper pair of rollers mounted on a pair of horizontal axes oriented parallel to the length of the horizontal leg wherein the horizontal axes are securely fixed to opposite lateral sides of the horizontal leg, such that the upper pair of rollers extend below the lower surface of the horizontal leg;

iv. a lower pair of rollers mounted on a pair of vertical axes wherein the vertical axes are securely fixed to opposite lateral sides of the vertical leg, such that the lower pair of rollers extend forward of the vertical surface of the vertical leg;

b. a lower component comprising:

i. an upper portion having a thickness less than the slot thickness such that the upper portion can fit into the slot and wherein the upper portion has two openings comprising a proximal opening and a distal opening that align with the two openings of the horizontal leg when the upper portion is inserted into the slot;

ii. a corner portion having a horizontal surface and a vertical surface for contacting the inside corner of the structural beam;

iii. a partial slot between the upper portion and the corner portion for accommodating at least a portion of the horizontal planar beam leg of the structural beam;

iv. a pair of lower component rollers mounted on a pair of vertical axes wherein the vertical axes are securely fixed to opposite lateral sides of the corner portion, such that the pair of lower component rollers extend rearward from the vertical surface;

c. a pair of quick release pins for passing through the two openings when the upper portion of the lower component is inserted into the slot of the horizontal leg of the upper component thereby securely attaching the upper component to the lower component; and d. a transverse opening through at least one of the upper component and the lower component for tying off one or more safety lines.

2. The fall protection device of claim 1 further comprising a locking mechanism for locking in place any of the group consisting of the upper pair of rollers, the lower pair of rollers, the pair of lower component rollers and combinations thereof to prevent rolling during use.

3. The fall protection device of claim 1 wherein when the upper portion of the lower component is inserted into the slot of the horizontal leg of the upper component and the pair of quick release pins are passed through the two openings thereby securely attaching the upper component to the lower component, a clearance of from 0.25 to 0.5 in is provided between the lower surface of the horizontal leg of the upper component and the upper surface of the structural beam and a clearance of from 0.25 to 0.5 in is provided between a rear surface of the corner portion of the lower component and a front surface of the structural beam.

4. The fall protection device of claim 1 wherein the fall protection device has an overall length from 10 to 20 in, the fall protection device has an overall height from 6 to 12 in and the fall protection device has an overall width from 4 to 8 in.

5. The fall protection device of claim 1 further comprising additional openings through the horizontal leg transverse to the length of the horizontal leg and additional openings in the upper portion of the lower component to align with the additional openings of the horizontal leg when the upper portion is inserted into the slot of the horizontal leg.

6. The fall protection device of claim 1 further comprising attachment means on the quick release pins for attaching the quick release pins to tethers for attaching to the workers.

7. A system for protecting workers during an operation at elevated height comprising:

a. a structural beam comprising a horizontal planar beam leg and a vertical planar beam leg wherein the horizontal planar beam leg and the vertical planar beam leg intersect forming an angle having an outside corner and an inside corner and wherein the horizontal planar beam leg comprises an upper surface of the structural beam, wherein the structural beam can be securely attached to an elevated structure selected from the group consisting of a storage tank, a reactor, a vessel, a building, and a bridge; and b. the fall protection device of claim 1, wherein the lower component of the fall protection device can be positioned such that the horizontal and vertical surfaces of the corner portion of the lower component contact the inside corner of the structural beam and wherein the upper component of the fall protection device can be positioned over the upper portion of the lower component such that the upper portion of the lower component fits into the slot of the upper component and the distal and proximal openings of the upper component and the lower component align such that the pair of quick release pins can be placed through the aligned distal and proximal openings of the upper component and the lower component thereby securing the fall protection device to the structural beam.

8. The system of claim 7 wherein the fall protection device of claim 1 further comprises a locking mechanism for locking in place any of the group consisting of the upper pair of rollers, the lower pair of rollers, the pair of lower component rollers and combinations thereof to prevent rolling during use.

9. The system of claim 7 wherein when the upper portion of the lower component is inserted into the slot of the horizontal leg of the upper component and the pair of quick release pins are passed through the two openings thereby securely attaching the upper component to the lower component, a clearance of from 0.25 to 0.5 in is provided between the lower surface of the horizontal leg of the upper component and the upper surface of the structural beam and a clearance of from 0.25 to 0.5 in is provided between a rear surface of the corner portion of the lower component and a front surface of the structural beam.

10. The system of claim 7 wherein the fall protection device has an overall length from 10 to 20 in, the fall protection device has an overall height from 6 to 12 in and the fall protection device has an overall width from 4 to 8 in.

11. The system of claim 7 wherein the fall protection device of claim 1 further comprises additional openings through the horizontal leg transverse to the length of the horizontal leg and additional openings in the upper portion of the lower component to align with the additional openings of the horizontal leg when the upper portion is inserted into the slot of the horizontal leg.

12. The system of claim 7 wherein the fall protection device of claim 1 further comprises attachment means on the quick release pins for attaching the quick release pins to tethers for attaching to the workers.

13. A method for protecting workers during an operation at elevated height comprising:

a. providing a structure comprising a structural beam comprising a horizontal planar beam leg and a vertical planar beam leg wherein the horizontal planar beam leg and the vertical planar beam leg intersect forming an angle having an outside corner and an inside corner and wherein the horizontal planar beam leg comprises an upper surface of the structural beam;

b. positioning the lower component of the fall protection device of claim 1 such that the horizontal and vertical surfaces of the corner portion of the lower component contact the inside corner of the structural beam at a desired location along the structural beam;

c. positioning the upper component of the fall protection device over the upper portion of the lower component such that the upper portion of the lower component fits into the slot of the upper component and the distal openings and proximal openings of the upper component and the lower component align;

d. placing the pair of quick release pins through the aligned distal and proximal openings of the upper component and the lower component, thereby securing the fall protection device to the structural beam.

14. The method of claim 13 further comprising tying off one or more safety lines to the transverse opening through at least one of the upper component and the lower component.

15. The method of claim 13 further comprising changing to a second desired location along the structural beam by rolling the fall protection device to the second desired location using the upper pair of rollers, the lower pair of rollers and the pair of lower component rollers.

16. The method of claim 13 wherein the structural beam is at a height of from six feet to hundreds of feet.

17. The method of claim 13 wherein the structural beam is securely attached to an elevated structure selected from the group consisting of a storage tank, a reactor, a vessel, a building, and a bridge.

18. The method of claim 17 wherein the structural beam is temporarily securely attached to the elevated structure.

19. The method of claim 17 wherein the structural beam is permanently securely attach to the elevated structure.

* * * * *